US007240887B2

(12) United States Patent
Buote

(10) Patent No.: US 7,240,887 B2
(45) Date of Patent: Jul. 10, 2007

(54) BOOK HOLDER

(76) Inventor: Brian Buote, 144 West Terrace Bay, Cochrane (CA) T4C 1R7

( * ) Notice: Subject to any disclaimer, the term of this patent is extended or adjusted under 35 U.S.C. 154(b) by 30 days.

(21) Appl. No.: 10/905,791

(22) Filed: Jan. 20, 2005

(65) Prior Publication Data

US 2006/0157630 A1 Jul. 20, 2006

(51) Int. Cl.
*A47B 97/04* (2006.01)

(52) U.S. Cl. ..... 248/447; 248/444.1; 248/451; 248/460; 248/461; 281/45; 281/46; 281/47; 281/48; 281/49; 281/50

(58) Field of Classification Search ..... 248/444.1, 248/447, 451, 460, 461; 206/450; 281/45–50; 412/5

See application file for complete search history.

(56) References Cited

U.S. PATENT DOCUMENTS 128,835 A * 7/1872 Willson ..... 40/357
864,066 A * 8/1907 Berwick ..... 248/461
1,728,431 A 9/1929 Mevi
2,709,440 A * 5/1955 Donato et al. ..... 281/49
3,136,082 A * 6/1964 Sloves ..... 40/530
4,116,413 A * 9/1978 Andersen ..... 248/451
4,159,836 A * 7/1979 Tarr ..... 281/45
4,296,946 A * 10/1981 Larre et al. ..... 281/45
4,467,920 A 8/1984 Smith
4,679,757 A * 7/1987 Mussari ..... 248/463
5,052,650 A * 10/1991 Beile et al. ..... 248/451
5,375,806 A * 12/1994 Debus et al. ..... 248/452
5,639,053 A * 6/1997 Dmitriev ..... 248/460
5,671,900 A * 9/1997 Cutler ..... 248/451
5,702,126 A * 12/1997 Engel ..... 281/29
5,746,410 A * 5/1998 Hung ..... 248/441.1
5,829,787 A * 11/1998 Newhouse, Jr. ..... 281/46
5,893,546 A 4/1999 Renfroe
5,913,502 A * 6/1999 Smith ..... 248/445
6,089,609 A * 7/2000 Denley ..... 281/42
6,220,559 B1 * 4/2001 Chow ..... 248/445
6,491,171 B2 * 12/2002 Maier-Hunke ..... 211/47

FOREIGN PATENT DOCUMENTS

DE 3542977 A1 * 6/1987
FR 2707557 A1 * 1/1995

* cited by examiner

*Primary Examiner*—Carl D. Friedman
*Assistant Examiner*—Michael McDuffie
(74) *Attorney, Agent, or Firm*—Stephen Lewellyn; Bay Area Patent Group, LLC

(57) ABSTRACT

A book holder for supporting and protecting an article of reading material is provided. The book holder includes a spine, a pair of cover panels, each of the cover panels is hingidly to the spine permitting the pair of cover panels to be rotated into an open position and to be rotated into a closed position. The book holder is adapted to receive and support an article of reading material in an open position when the book holder is open and for enclosing and protecting the reading material when the book holder is closed. A page holder assembly is provided to hold the reading material open and for marking a page. The page holder assembly can also include a line marker for marking a line of text in the reading material. In additional embodiments, an illumination means for illuminating the reading material and a magnify sheet for magnify the reading material may be provided.

10 Claims, 6 Drawing Sheets

BOOK HOLDER

BACKGROUND OF THE INVENTION

1. Field of the Invention

The present invention relates generally to a book holder. More particularly, relating to a closable book holder that when open is adapted to support an article of reading material for reading and that when closed is adapted to enclose and protect the article of reading material.

2. Description of the Prior Art

It is desirable to have a device for supporting an article of reading material for reading by a reader, and which provides hands free reading of the article of reading material by the reader. This is even more desirable with physically challenged individuals. Examples of such devices are described in U.S. Pat. Nos. 4,679,757; 1,728,431; 4,116,413; 5,893,546; 3,136,082; and 4,467,920.

Heretofore prior art devices for supporting reading material do not address the problem of protecting the reading material during periods time where the reader is not reading the material. Therefore a void exists in the prior art, and the apparatus of the present invention fills the void by providing a support for reading material which protects the reading material when not being read.

SUMMARY OF THE INVENTION

In accordance with the present invention, a book holder for supporting and protecting an article of reading material is provided.

The book holder includes a spine having opposed side edges, a pair of cover panels, each of the cover panels is hingidly attached along an interior edge thereof to one of the opposed side edges of the spine permitting the pair of cover panels to be rotated into an open position where the cover panels are substantially parallel to the spine and to be rotated into a closed position where the cover panels are substantially normal to said spine, each cover panel has a lip formed around the free edges and extending outwardly from an inner surface thereof, the lip of each of cover panel together defining a compartment adapted to receive and support an article of reading material book therein, the lip of each of the pair of cover panels serving as a support for an article of reading material when the pair of cover panels are rotated into the open position, and the lip of each of the pair of cover panels enclosing the book within the compartment when the pair of cover panels are rotated into to the closed position, and a prop for supporting the book holder upon a support surface.

In an additional embodiment the book holder includes a page holder assembly attached an inner surface of the spine approximate a top edge thereof, the page holder assembly is adapted to be pivoted outwardly from the inner surface of the spine to facilitate the insertion of an article of reading material within the compartment, and then being pivoted inward to abut and hold the article of reading material within the compartment.

In yet an additional embodiment the book holder includes an illumination means for illuminating the article of reading material.

In a further embodiment the book holder includes a magnifier positioned over the article of reading material so as to magnify the content of the article of reading material. The magnifier can be of a line marker that is slidable along the reading material.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures

DETAILED DESCRIPTION OF THE INVENTION

Figure 1:
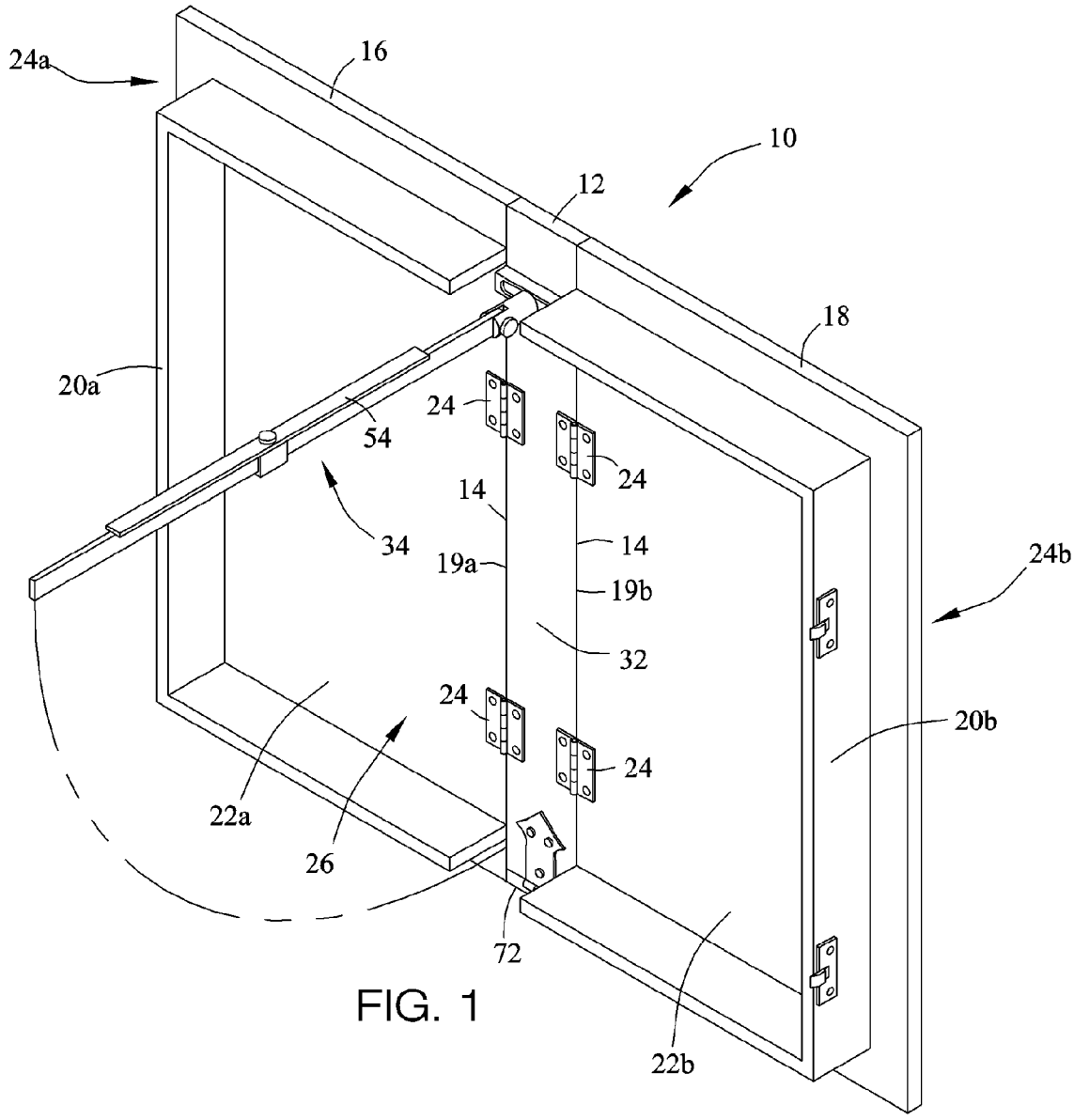
FIG. 1 is a perspective view of a preferred embodiment of the book holder constructed in accordance with the principles of the present invention.

Referring now to the drawings, and particularly to FIGS. 1-8, a preferred embodiment of the book holder of the present invention is shown and generally designated by the reference numeral 10.

Figure 2:
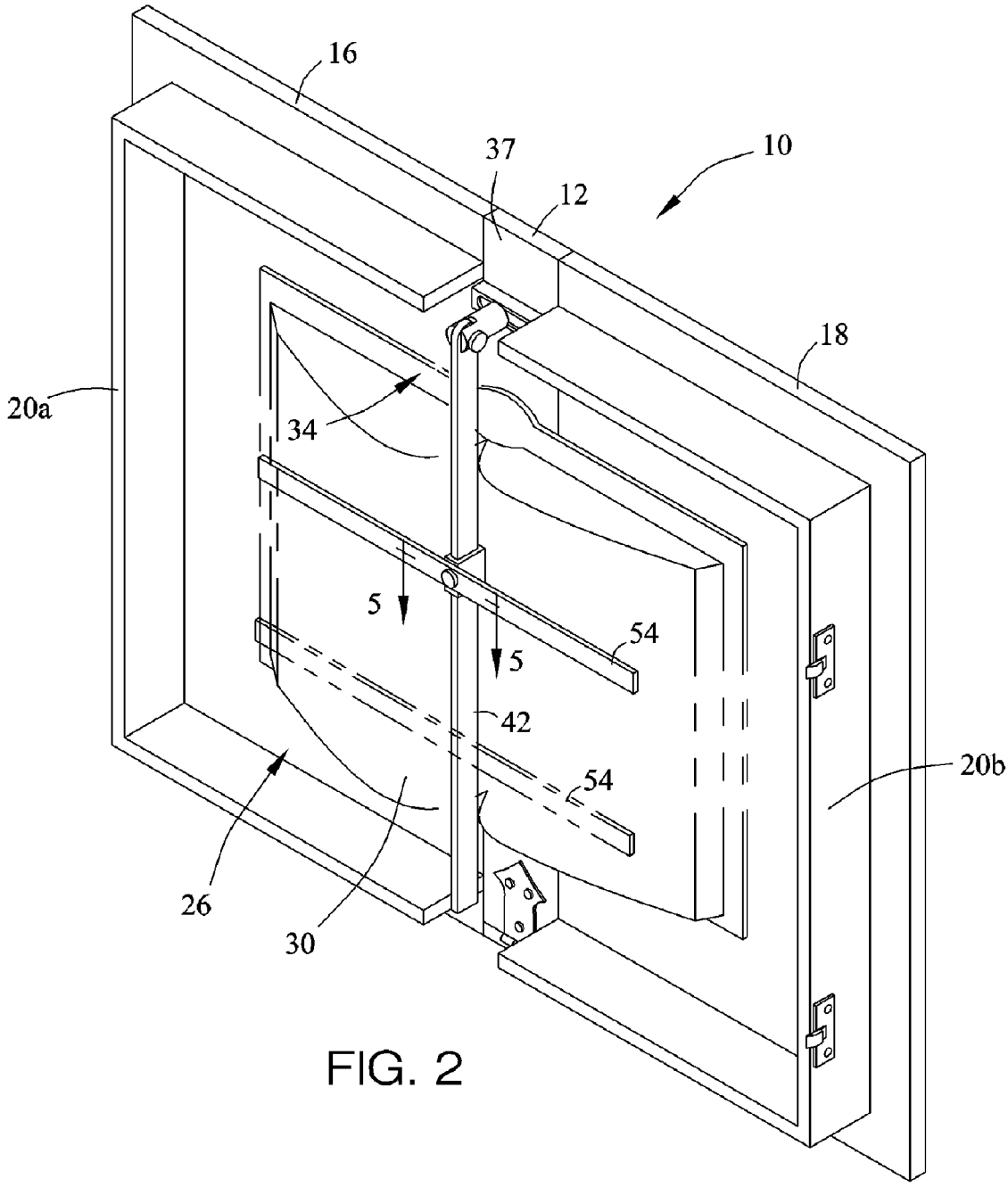
FIG. 2 is an in-use perspective view of the book holder illustrated in FIG. 1.

In FIGS. 1 and 2, a new and improved book holder 10 of the present invention for supporting and protecting an article of reading material, such as a book is illustrated and will be described. More particularly, the book holder 10 includes a spine 12 having opposed side edges 14, a first cover panel 16 and a second cover panel 18. The first and second cover panels 16 and 18 each have an interior edge 19*a* and 19*b* respectively and are attached along their respective interior edges to the opposed side edges 14 of the spine 12 by a plurality of hinges 24. The construction of the book holder 10 should not be limited to the type of hinges 24 as illustrated, as many different types of hinges could be implemented.

The hinges 24 permit each cover panel 16 and 18 to rotate into an open position where the cover panels are parallel with the spine 12 and into a closed position where the cover panels are normal to the spine. In the open position, as shown in FIGS. 1 and 2, the spine 12 and the cover panels 16 and 18 are parallel and lie within a common plane. In the closed position, as shown later in FIG. 6, the cover panels 16 and 18 are rotated into to a closed position that is normal to the spine 12, but parallel to one another. The book holder 10 is of a construction which simulates the appearance of a hard cover book. This construction allows for the compact and discreet storage of the book holder 10, as it blends in with surrounding reading material. For example, the book holder 10 in the closed position can be placed onto a book shelf and be obscured by other books placed on the shelf.

Each cover panel 16 and 18 includes a lip 20*a* and 20*b* extending outwardly from an inner surface 22*a* and 22*b* of each cover panel respectively. Each lip 20*a* and 20*b* are formed along the free edges 24*a* and 24*b* of the cover panels 16 and 18 and together with the inner surfaces 22*a* and 22*b* define a reading material compartment, generally designated by reference numeral 26, for receiving an article of reading material 30 therein. Preferably, the lips 20*a* and 20*b* are formed at a spaced distance inward from the free edges 24*a* and 24*b* of the cover panels 16 and 18. When each cover panel 16 and 18 are rotated into the open position, the lips 20*a* and 20*b* serve to support a lower edge of the article of reading material 30 with a back surface of the reading material resting upon the inner surfaces 22*a* and 22*b* of the cover panels 16 and 18 and with the spine of the reading material resting along an inner surface 32 of the spine 12.

The book holder 10, further includes a page holder assembly 34 for retaining the reading material 30 within the compartment 26, for marking a page within the reading material, and optionally for marking a particular line in the reading material. The page holder assembly 34 is described in further detail below.

Figure 3A:
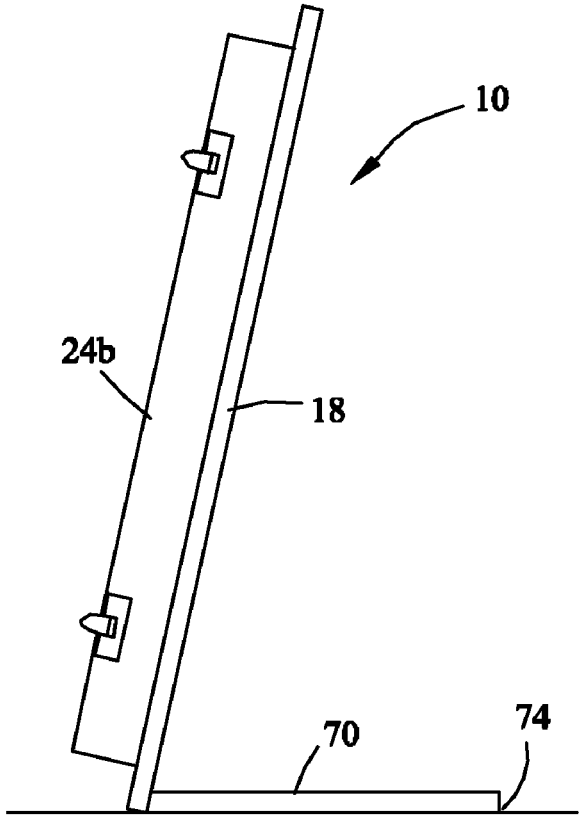
FIG. 3*a* is a side elevation view of the book holder illustrating the book holder supported upon a support surface by a prop.
Figure 3B:
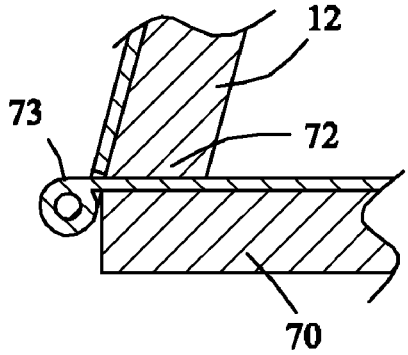
FIG. 3*b* is a detailed cross-sectional view of a hinged coupling between the spine and the prop.

Now with reference to FIGS. 3*a* and 3*b*, a prop 70 is hingidly attached to a bottom edge 72 of the spine 12 by a hinge 73. The prop 70, when rotated into an in-use position as illustrated, supports the book holder 10 in a generally upright or inclined orientation upon a support surface 74. The bottom edge 72 of the spine 12 can be cut at angle to control the degree of inclination of the book holder 10. The prop 70 can be rotated into a closed position where it rests against the book holder 10 allowing for compact storage thereof.

Figure 4:
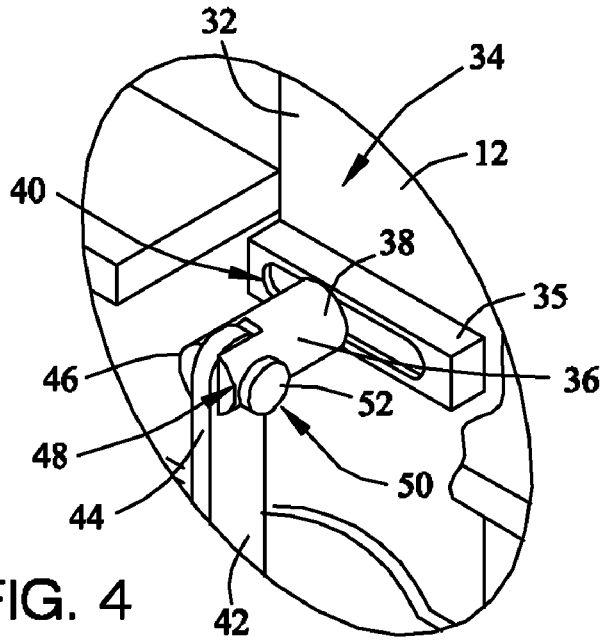
FIG. 4 is a detailed perspective view of a page holder assembly shown in alternate positions.

Referring back to FIG. 2 and with reference to FIG. 4, the page holder assembly 34 includes a bracket 4 35 attached to the inner surface 32 of the spine 12 approximate a top edge 37, a standoff 36 having a first end 38 is slidably received within a slot 40 formed laterally across the bracket, and an elongated page marking arm 42 pivotally attached at one end 44 to a second end 46 of the standoff at pivot point 48. The standoff 36 being slidably received by the slot 40 permits the page marking arm 42 to slide towards either side edge 14 of spine 12. The page marking arm 42 is of a length substantially equally to the length of the compartment 26.

The page holder assembly 34 can include a locking means 50 for securing the page marking arm 42 from rotating about the standoff 36. The locking means 50 is attached at the pivot point 48 and is turned in one direction to lock the page marking arm 42 from rotating and is turned in an opposite direction to allow the rotation of the page marking arm. The locking means 50 can comprise a threaded lock knob 52 received by the pivot point 48.

As shown in FIG. 1, the page marking arm 42 is rotatable outwardly about pivot point 48 permitting the placement of the article of reading material 30 within the compartment 26, and then rotated back so as to abut against the spine of the reading material, as shown in FIG. 2.

Additionally, the page holder assembly 34 can include a line marker 54 slidably attached to the page marking arm 42. The line marker 54 extends across and retains the reading material 30 in an open position. The line maker 54 is slid along the page marking arm 42 to mark different lines of text in the reading material 30. The line marker 54 in addition to being able to slide along the length of the page marking arm 42 it is rotatable with respect to the page marking arm allowing the line marker to be rotated into a position parallel to the page marking arm, as shown in FIG. 1, permitting closing of the book holder 10. The line marker 54 can be of an optical material lending magnifying properties to the line marker for magnifying lines of text.

Figure 5:
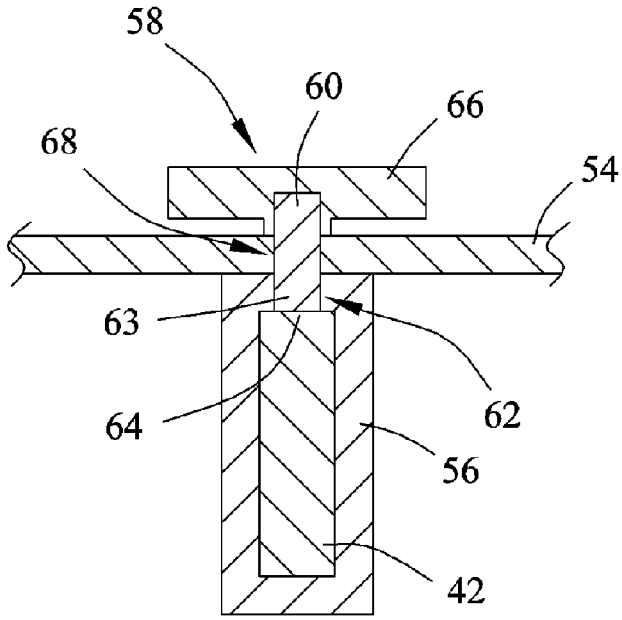
FIG. 5 is a cross-sectional view of the page holder assembly taken along line 5-5 in FIG. 2.

With reference to FIG. 5, the line marker 54 is attached to the page marking arm 42 through the use of a sliding element 56 which is free to slide along the length of the page marking arm. A lock means 58 having a threaded shaft 60 is threadably received within a bore 62 formed through the sliding element 56. When the lock means 58 is tightened an end 63 of the shaft 60 bears against a surface 64 of the page marking arm 42, thereby preventing the sliding element 58 from sliding along the page marking arm. A knob 66 is attached to the opposite end of the threaded shaft 60 allowing easy grasping by a user. Additionally, the threaded shaft 60 is received through a hole 68 formed through the line marker 54 such that the link maker is rotatable about the threaded shaft when the lock means 58 is not engaged.

Figure 6:
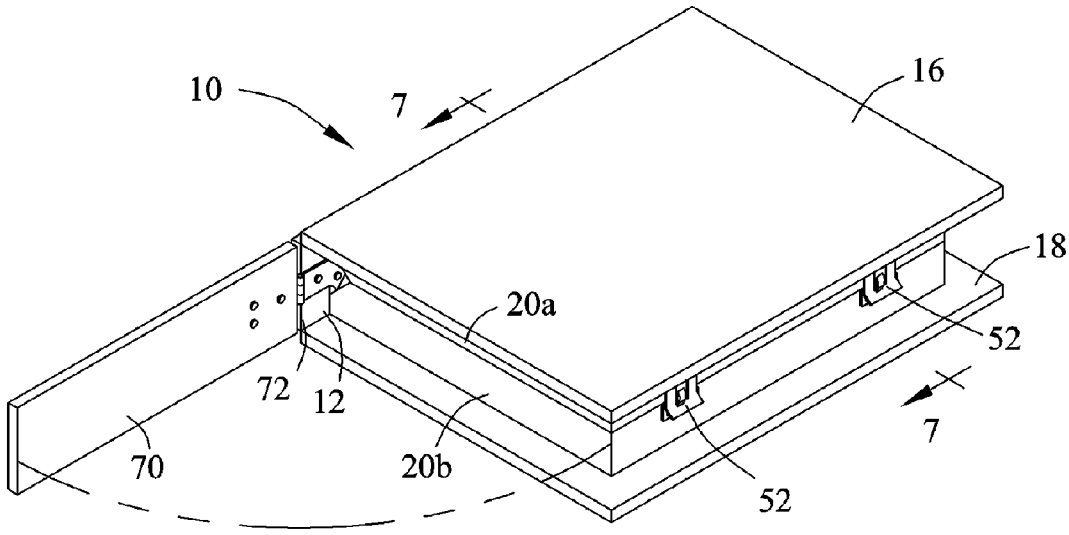
FIG. 6 is a perspective view the book holder in a closed position showing the prop in alternate positions.

Now referring to FIG. 6, the book holder 10 is shown closed with the first and second cover panels 16 and 18 rotated into the closed position enclosing the article of reading material 30 within the book holder. The prop 70 is show in alternate positions being rotated into a storage position where it is received between the cover panels 16 and 18 and rests against the lips 20*a* and 20*b*. The cover panels 16 and 18 can be locked into the closed position by at least one latch 52.

Figure 7:
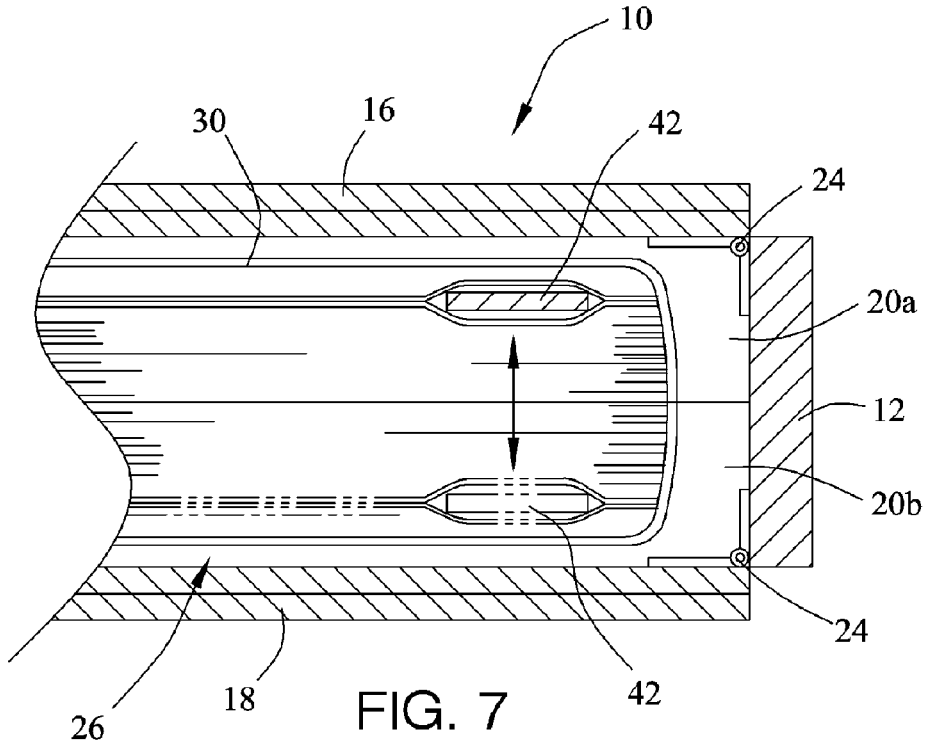
FIG. 7 is an in-use cross sectional view of book holder closed taken along line 7-7 in FIG. 6, and which illustrates the pager holder assembly in alternate positions within an article of reading material.

Turning now to FIG. 7, which is a cross-sectional view of the book holder 10 closed. The reading material 30 is enclosed within compartment 26. As shown, the lips 20*a* and 20*b* protect the edges of the reading material 30, the cover panels 16 and 18 protect the covering of the reading material, and the spine 12 protects the spine of the reading material. Additionally, the page marking arm 42 is shown in alternate locations within the reading material 30 to illustrate the ability of the page marking arm to be positioned along the spine 12 of the book holder 10 in accordance with the position of the page marking arm within the reading material when the reading material is closed along with the closing of the book holder. When the book holder 10 is open, the page marking arm 42 is aligned with the spine of the reading material 30 and generally aligned along a center-line of the spine 12 of the book holder, as shown in FIG. 2. However, as the book holder 10 is closed, the page marking arm 42 is caused to slide to either side of the spine 12 to accommodate various thickness of reading material and to prevent bending of the page marking arm which would result in damage to the arm as well as the reading material 30. The distance and the direction in which the page marking arm 42 is slid to either side is a direct relation to the thickness of the reading material and the location of the page marking arm 42 within the reading material as it is closed.

Figure 8:
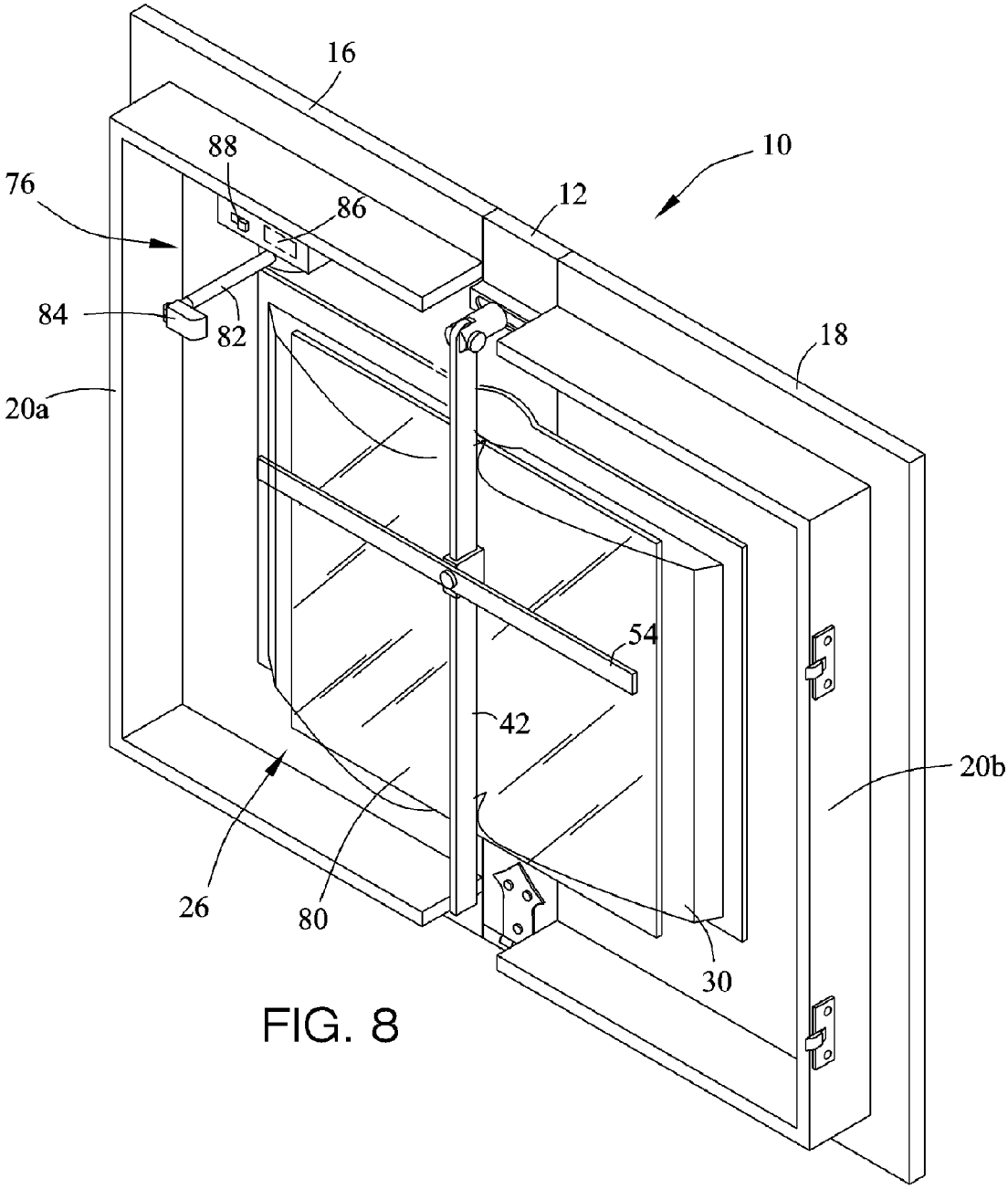
FIG. 8 is a perspective view of an alternate embodiment of the book holder.

With reference to FIG. 8, an alternate embodiment of the book holder 10 is shown having an illumination means 76 and optionally a magnifier 80, such as planer sheet-type that is positioned above the reading material 30. The magnifier 80 can be positioned between the reading material 30 and the page marking arm 42.

The illumination means 76 is positioned with in the compartment 26 so as to be enclosed by the book holder 10 when the book holder is closed. The illumination means 76 is positionable with respect to the reading material 30 to direct light onto the surface of the reading material for reading in a dark environment. The illumination means 76 can be positioned on either side of the reading material 30, or multiple illumination means can be provided and positioned along the reading material. Furthermore, while the illumination means 76 is shown positioned above the reading material different positions of the illumination means is contemplated, such as along the sides of the reading material. By way of example only, the illumination means 76 can include a positionable arm 82 attached at one end to the book holder 10, an light source 84 attached to the opposite end of the positionable arm, a power source 86, such as a battery, and a switch 88 for turning the light source off and on.

Figure 9A:
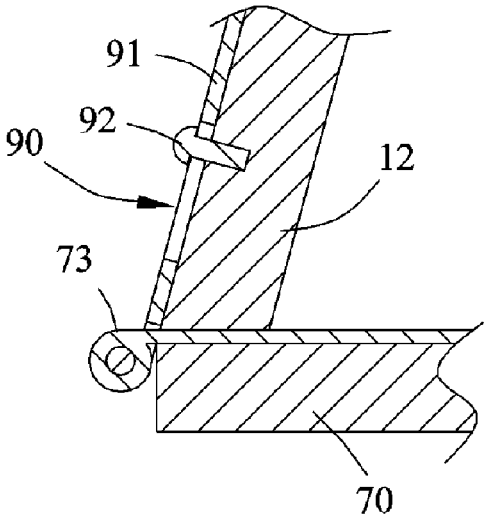
FIG. 9*a* is a detailed cross-sectional view of an alternate hinged coupling between the spine and the prop permitting the adjustment of the inclination of the book holder, which shows the book holder at first inclination.
Figure 9B:
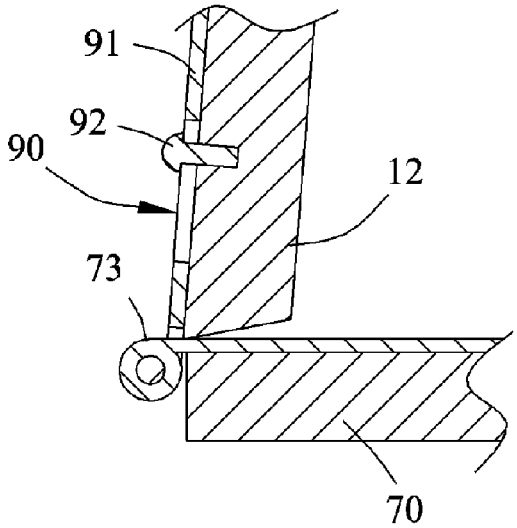
FIG. 9*b* the book holder of FIG. 9*a* showing the book holder at a second inclination.

Now with reference to FIGS. 9*a* and 9*b*, an alternate hinged coupling between the spine 12 and the prop 70 is shown, wherein the spine is slidably attached to the hinge 73. The hinge 73 includes at least one vertically orientated slot 90 formed through the leaf 91 of the hinge that is attached to the spine 12. The leaf 91 is secured to the spine 12 by a fastener 92 which is passed through the slot 90 and fixedly secured to the spine. The fastener 92 is free to slide along the slot 90 permitting the spine 12 to slide along the leaf 91. FIG. 9*a* illustrates the spine 12 at a first inclination and FIG. 9*b* illustrates the spine at a second inclination. The particular inclinations of the spine 12 shown in FIGS. 9*a* and 9*b* are for exemplary purposes only. As the inclination of the spine 12 is increased or decreased the spine slides along the leaf 91 until a desired inclination is reached.

A number of embodiments of the present invention have been described. Nevertheless, it will be understood that various modifications may be made without departing from the spirit and scope of the invention. Accordingly, other embodiments are within the scope of the following claims.

What is claimed is:

1. A book holder for supporting and protecting an article of reading material, the book holder comprising:

a spine having opposed side edges, a top edge and an inner surface;

a pair of cover panels, each of said pair of cover panels is hingedly attached along an interior edge thereof to one of said opposed side edges of said spine permitting said pair of cover panels to be rotated into an open position where said cover panels are substantially parallel to said spine and to be rotated into a closed position where said pair of cover panels are substantially normal to said spine;

a lip, each of said pair of cover panels having said lip formed around a free edge and extending outwardly from an inner surface thereof, said lip of each of said pair of cover panels together defining a compartment adapted to receive and support an article of reading material therein, said lip of each of said pair of cover panels serving as a support for an article of reading material when said pair of cover panels are rotated into said open position, and said lip of each of said pair of cover panels enclosing said book within said compartment when said pair of cover panels are rotated into said closed position; and a page marking arm attached approximate said top edge of said spine at an elevated distance above said inner surface;

said page marking arm being pivotable outwardly from said inner surface of said spine to facilitate the insertion of said article of reading material within said compartment, and then being pivoted inward to abut and hold said article of reading material within said compartment; and said page marking arm being slidable towards either of said opposed side edges of said spine.

2. The book holder as recited in claim 1 further comprising:

a line marker slidably attached to said page marking arm such that said line marker is slidable along the length of said page marking arm.

3. The book holder as recited in claim 2, further comprising:

a locking means for locking said line marker in a stationary position along said page marking arm.

4. The book holder as recited in claim 2, wherein said line marker is attached at a midpoint thereof to said page marking arm.

5. The book holder as recited in claim 4, wherein said line marker is rotatable with respect to said page marking arm such that said line marker can be rotated into a position parallel to said page marking arm, thereby allowing said cover panels to be rotated into said closed position.

6. The book holder as recited in claim 1, further comprising:

a prop means for supporting said book holder at an inclined angle upon a support surface, said prop means is hingidly attached to said spine permitting said prop means spine to be rotated into a deployed position for supporting said book holder and to be rotated into a non-use, stored position against said book holder.

7. The book holder as recited in claim 6, wherein said prop means supports said book holder at an inclined angle upon said support surface.

8. A book holder comprising:

a spine having opposed side edges, a top edge and an inner surface;

a pair of cover panels, each of said cover panels is hingedly attached along an interior edge thereof to one of said opposed side edges of said spine permitting said pair of cover panels to be rotated into an open position where said cover panels are substantially parallel to said spine and to be rotated into a closed position where said cover panels are substantially normal to said spine;

a lip, each of said pair of cover panels having said lip formed around a free edge and extending outwardly from an inner surface thereof, said lip of each of said pair of cover panels together defining a compartment adapted to receive and support a book therein, said lip of each of said pair of cover panels serving as a support for an article of reading material when said pair of cover panels are rotated into said open position, and said lip of each of said pair of cover panels enclosing said book within said compartment when said pair of cover panels are rotated into said closed position;

a standoff having a first end slidably received by a slot extending laterally across said inner surface of said spine approximate said top edge thereof;

a page marking arm pivotally attached at a first end thereof to a second end of said standoff, such that said page marking arm is rotatable outwardly from said inner surface of said spine to facilitate the insertion of an article of reading material within said compartment, and then being rotatable inwardly to about and hold the article of reading material within said compartment;

said page marking arm and said standoff being slidable towards either of said opposed side edges of said spine; and a prop means for supporting said book holder at an inclined angle upon a support surface, said prop means is hingidly attached to said s me permitting said prop means to be rotated into a deployed position for supporting said book holder and to be rotated into a non-use, stored position against said book holder.

9. The book holder as recited in claim 8, further comprising:

a line marker slidably attached to said page marking arm such that said line marker is slidable along the length of said page marking arm; and wherein said line marker is rotatable with respect to said page marking arm such that said line marker can be rotated into a position parallel to said page marking arm, thereby allowing said cover panels to be rotated into said closed position.

10. The book holder as recited in claim 8, wherein said line marking arm is a magnifier.

* * * * *